US011425989B2

(12) United States Patent
Hebert

(10) Patent No.: US 11,425,989 B2
(45) Date of Patent: Aug. 30, 2022

(54) DETANGLING BRUSH

(71) Applicant: Mitch & Hebert, LLC., North Las Vegas, NV (US)

(72) Inventor: Tamela Hebert, North Las Vegas, NV (US)

(73) Assignee: Mitch & Herbert, LLC, North Las Vegas, NV (US)

( * ) Notice: Subject to any disclaimer, the term of this patent is extended or adjusted under 35 U.S.C. 154(b) by 0 days.

(21) Appl. No.: 16/810,052

(22) Filed: Mar. 5, 2020

(65) Prior Publication Data

US 2021/0007473 A1 Jan. 14, 2021

Related U.S. Application Data

(60) Provisional application No. 62/872,852, filed on Jul. 11, 2019.

(51) Int. Cl.
*A46B 9/02* (2006.01)
*A46B 5/02* (2006.01)
(Continued)

(52) U.S. Cl.
CPC ..... *A46B 9/023* (2013.01); *A46B 5/002* (2013.01); *A46B 5/0004* (2013.01);
(Continued)

(58) Field of Classification Search
CPC ..... A46B 5/00; A46B 5/0004; A46B 5/0012; A46B 5/02; A46B 5/021; A46B 5/04; A46B 7/00; A46B 7/02; A46B 7/06; A46B 9/00; A46B 9/02; A46B 9/023; A46B 9/08; A46B 9/10; A46B 9/12; A46B 15/00; A46B 2200/104; A45D 1/18; A45D 2/002;
(Continued)

(56) References Cited

U.S. PATENT DOCUMENTS 2,150,260 A * 3/1939 Berry ..... A45D 24/14 132/149
3,151,346 A * 10/1964 Gray ..... A46B 5/04 15/187
(Continued)

FOREIGN PATENT DOCUMENTS

EP 141532 * 5/1985
FR 2273493 * 1/1976
(Continued)

*Primary Examiner* — Mark Spisich
(74) *Attorney, Agent, or Firm* — Eric Karich; Karich & Associates

(57) ABSTRACT

A detangling brush has a top brush head and a bottom brush head connected with a hinge. The top brush head includes a top perimeter frame having a first plurality of inwardly extending fingers which are laterally spaced from each other, and further have a plurality of top bristles which project downwardly from at least some of the first plurality of inwardly extending fingers. At least one ring is mounted on the top brush. The bottom brush head has a bottom perimeter frame which includes a second plurality of inwardly extending fingers which are laterally spaced from each other, and further have a plurality of bottom bristles which project upwardly from at least some of the second plurality of inwardly extending fingers of the bottom brush head.

7 Claims, 4 Drawing Sheets

(51) Int. Cl.
*A46B 7/06* (2006.01)
*A46B 5/00* (2006.01)

(52) U.S. Cl.
CPC ..... *A46B 5/0012* (2013.01); *A46B 5/02* (2013.01); *A46B 5/021* (2013.01); *A46B 7/06* (2013.01); *A46B 9/025* (2013.01); *A46B 9/026* (2013.01); *A46B 2200/104* (2013.01)

(58) Field of Classification Search
CPC ..... A45D 2/42; A45D 24/06; A45D 24/14; A45D 24/16
USPC ..... 15/106, 143.1, 159.1, 160, 201, 203; 132/129, 149; D4/119–121, 129
See application file for complete search history.

(56) References Cited

U.S. PATENT DOCUMENTS 4,116,205 A 9/1978 Owen et al.
4,467,491 A 8/1984 Dekker
5,285,774 A * 2/1994 Stachurski ..... A46B 5/002 132/129
5,335,390 A 8/1994 Chen
6,196,235 B1 3/2001 Kim
6,367,111 B1 * 4/2002 Chen ..... A46B 5/0012 15/160
6,477,732 B1 11/2002 Cline et al.
D505,550 S 5/2005 Akashi et al.
8,857,005 B2 10/2014 Shim et al.
9,038,224 B1 5/2015 Esquibel
2010/0101594 A1 4/2010 Pulfrey
2010/0139684 A1 6/2010 Smith et al.
2016/0338479 A1 11/2016 Rosenzweig
2017/0020276 A1 1/2017 Brewer et al.
2017/0355090 A1 * 12/2017 Spencer ..... B26B 21/527

FOREIGN PATENT DOCUMENTS

FR 2571944 * 4/1986
JP 2018-161457 * 10/2018

* cited by examiner

DETANGLING BRUSH

CROSS-REFERENCE TO RELATED APPLICATIONS

This application for a utility patent claims the benefit of U.S. Provisional Application No. 62/872,852, filed Jul. 11, 2019.

BACKGROUND OF THE INVENTION

Field of the Invention

This invention relates generally to hair brushes, and more particularly to a detangling brush having a top brush head and a bottom brush head which may hinge between open and closed positions.

Description of Related Art

The prior art shows examples of hair brushes which have multiple frames that move relative to one another. For example, Shim, U.S. Pat. No. 8,857,005, teaches hair brush that permits quick and easy removal of hair, having a handle attached to a head. The head is made up of at least two frames that are mounted to the handle through cantilevers that permit movement of the frames relative to one another. The bristles are mounted to the frames, preferably in single rows. A force applied to one frame moves that frame relative to the other frame and the handle, thereby permitting the user to reach between the frames to remove any hair that is caught in the bristles.

Other prior art hair brushes have bristle arrangements which project inwardly such that they each project into gaps and the top and bottom frames may be closed around hair.

The prior art teaches detangling brushes with top and bottom brush heads. However, the prior art does not teach a closeable detangling brush with bristles that project from laterally extending fingers, nor a detangling brush adapted to be manipulated with fingers using rings. The present invention fulfills these needs and provides further advantages as described in the following summary.

SUMMARY OF THE INVENTION

The present invention teaches certain benefits in construction and use which give rise to the objectives described below.

The present invention provides a detangling brush comprising a top brush head having a top perimeter frame which includes a first plurality of inwardly extending fingers that extend from the top perimeter frame. Each of the first plurality of inwardly extending fingers are laterally spaced from each other, and further have a plurality of top bristles which project downwardly from at least some of the first plurality of inwardly extending fingers of the top brush head. At least one ring is mounted on an outer surface of the top brush, being sized and adapted to receive a user's fingers. The detangling brush further comprises a bottom brush head having a bottom perimeter frame which includes a second plurality of inwardly extending fingers that extend from the bottom perimeter frame. Each of the second plurality of inwardly extending fingers of the bottom brush head are laterally spaced from each other, and further have a plurality of bottom bristles which project upwardly from at least some of the second plurality of inwardly extending fingers of the bottom brush head. A hinge hingably connects the top and bottom brush heads.

A primary objective of the present invention is to provide a detangling brush having advantages not taught by the prior art.

Another objective is to provide a detangling brush having a plurality bristles on top and bottom brush heads which are mounted on laterally extending fingers.

A further objective is to provide a detangling brush having at least one ring adapted to receive a user's fingers to manipulate opening and closing of the detangling brush.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a detangling brush that is useful as a brush, and which folds down into a compact closed configuration for travel and storage.

Figure 1:
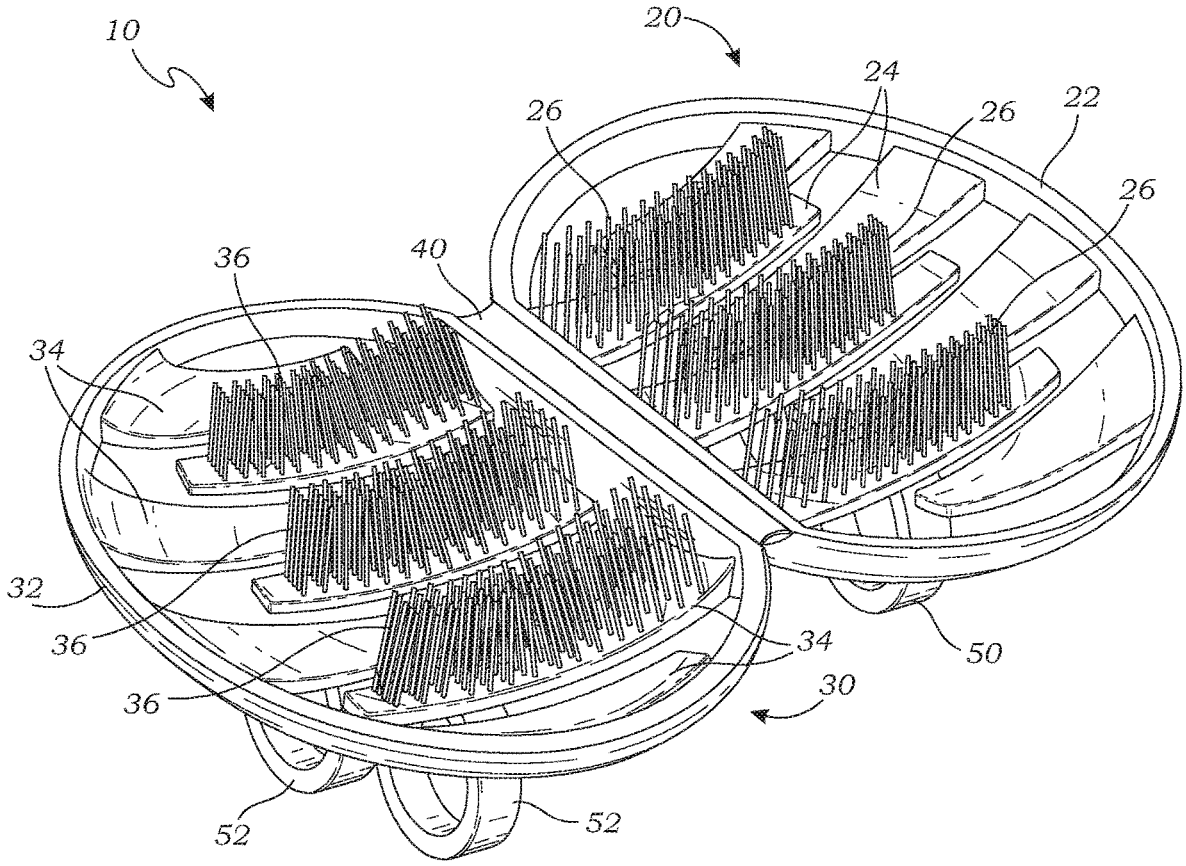
FIG. 1 is a perspective view of a detangling brush, according to one embodiment of the present invention, shown in an open configuration.
Figure 2:
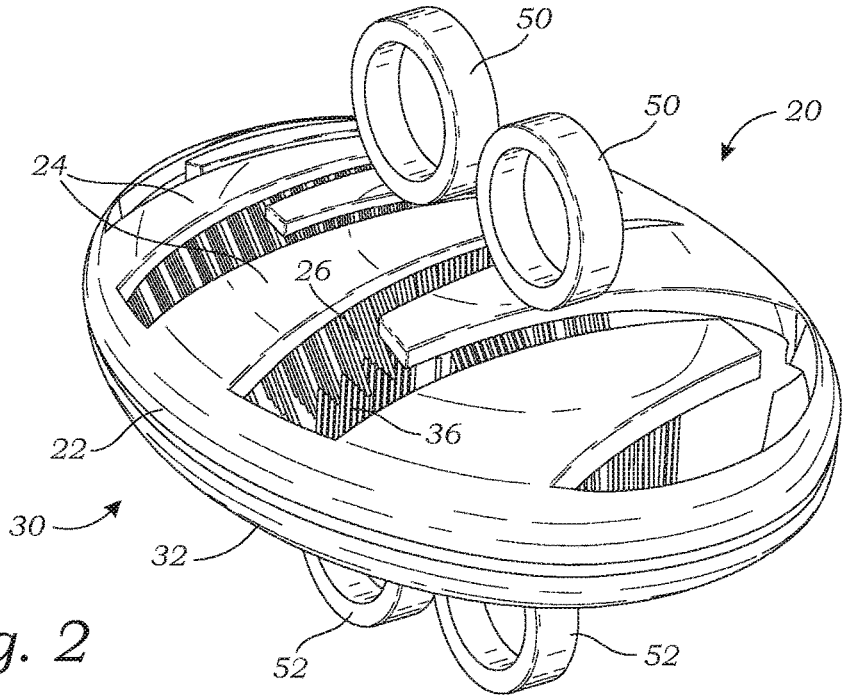
FIG. 2 is a perspective view thereof, illustrating the detangling brush in a closed configuration.

FIG. 1 is a perspective view of the detangling brush 10, according to one embodiment of the present invention and shown in an open configuration. FIG. 2 is a perspective view thereof, in a closed configuration. As shown in FIGS. 1-2, the detangling brush 10 comprises a top brush head 20 and a bottom brush head 30 which are connected by a living hinge 40 to fold between the open and closed configurations.

As shown in FIGS. 1-2, the top brush head 20 has a top perimeter frame 22, which forms the outer structure of the top of the brush 10. The top perimeter frame 22 includes a first plurality of inwardly extending fingers 24 that extend from the top perimeter frame 22. Each of the first plurality of inwardly extending fingers 24 may be laterally spaced from each other, such that any water will easily drain out of the detangling brush 10. In this embodiment, the fingers 24 alternately project from opposite sides of the frame 22. The top brush head 20 further include plurality of top bristles 26 which project downwardly from at least some of the inwardly extending fingers 24. For purposes of this application, the term "bristles" is defined to include any form of bristles, pins, and equivalent structures that are suitable for brushing hair. The number of fingers 24 that include the bristles, and the precise configuration of the bristles may vary according to the requirements of the product designer, and different arrangements of bristles should be considered within the scope of the present invention.

As shown in FIGS. 1-2, at least one ring 50 is mounted on the top perimeter frame 22 and is adapted to receive a user's fingers for holding the brush 10. In this embodiment, there are two rings, but in other embodiments, there may be a greater or fewer number of rings 50. The rings 50 may be rigid structures made of plastic or other suitable material, or alternatively could be flexible rings constructed of fabric, leather, or other suitable material. The rings 50 may be integrally formed with the top perimeter frame 22, or may be attached via any known form of fastener (e.g., mechanical fasteners, adhesive, welding, etc.).

The bottom brush head 30 has a bottom perimeter frame 32 which includes a second plurality of inwardly extending fingers 34 that extend from the bottom perimeter frame 32. Each of the second plurality of inwardly extending fingers 34 may be laterally spaced from each other, and further comprise a plurality of bottom bristles 36 which project upwardly from at least some of the inwardly extending fingers 34. In this embodiment, the fingers 34 alternately project from opposite sides of the frame 32. In alternative embodiments, different configurations of fingers 24 and 34 may be used, and said different configurations should be considered within the scope of the present invention.

At least one ring 52 is mounted on the bottom perimeter frame 32 and is adapted to receive the user's fingers for holding the brush 10. In one application of the present invention, the user's first and second fingers are in the rings 50 of the top brush 20, with the thumb using one of the rings 52 of the bottom brush 30. The rings 50 an 52 may be different sizes to accommodate different finger sizes and placements, and may be positioned on any of the inwardly extending fingers 24 and 34.

In this embodiment, the top and bottom perimeter frames 22 and 32 are generally ovoid in shape, which may allow for a user's hand to easily contour and grip the detangling brush 10. However, in other embodiments, the frames 22 and 32 may be a different shape, as is well known in the art, and should be considered within the scope of the present invention.

Figure 3:
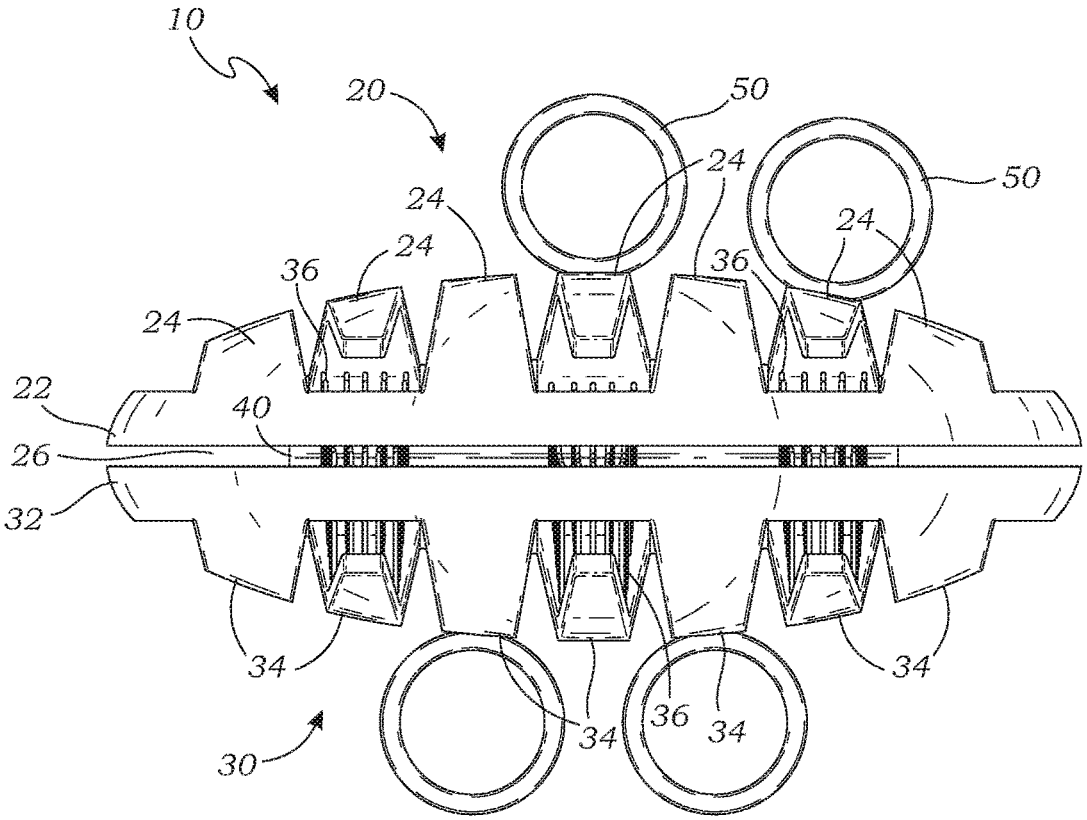
FIG. 3 is a front elevational view thereof.
Figure 4:
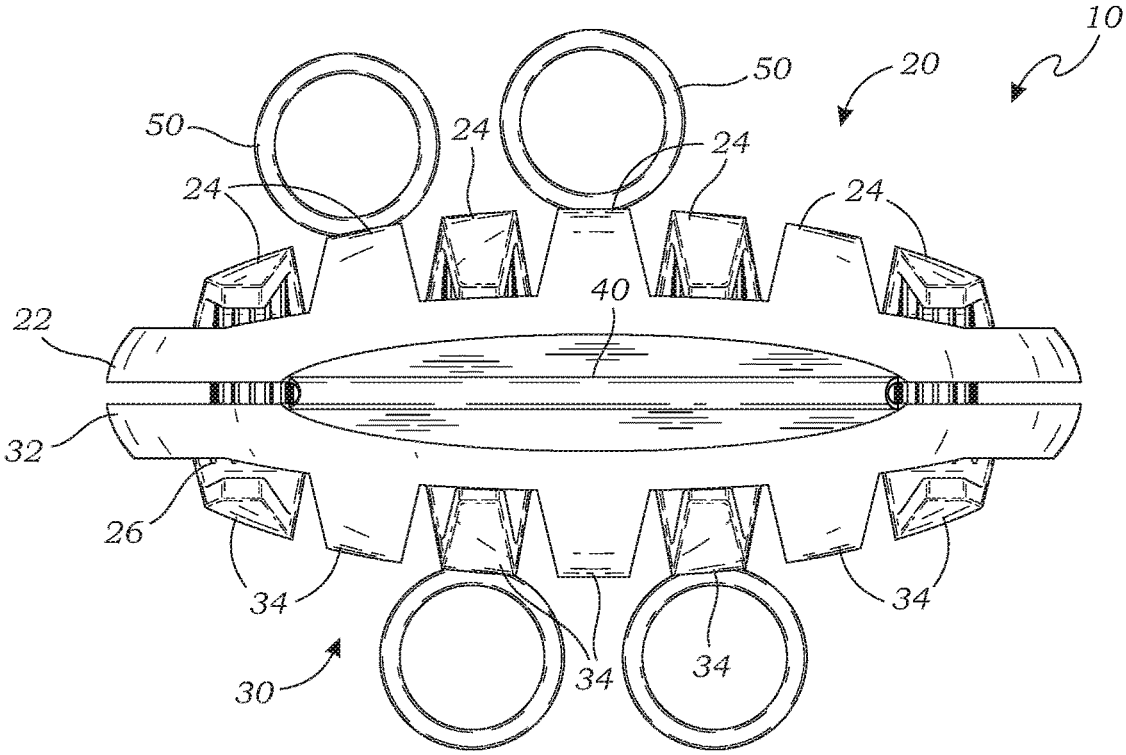
FIG. 4 is a rear elevational view thereof.

FIG. 3 is a front elevational view of the detangling brush 10, and FIG. 4 is a rear elevational view thereof, showing the living hinge 40 connecting the top and bottom perimeter frames 22 and 32. The detangling brush 10 may be hinged in either the open (as shown in FIG. 1) or closed configurations. In use, a user may pass his or her fingers through the rings 50, and pull the opposing bristles 26 and 36 through hair for detangling. The detangling brush 10 may be used in the open configuration, the closed configuration, or in a partially open configuration, as needed to detangle hair.

Figure 5:
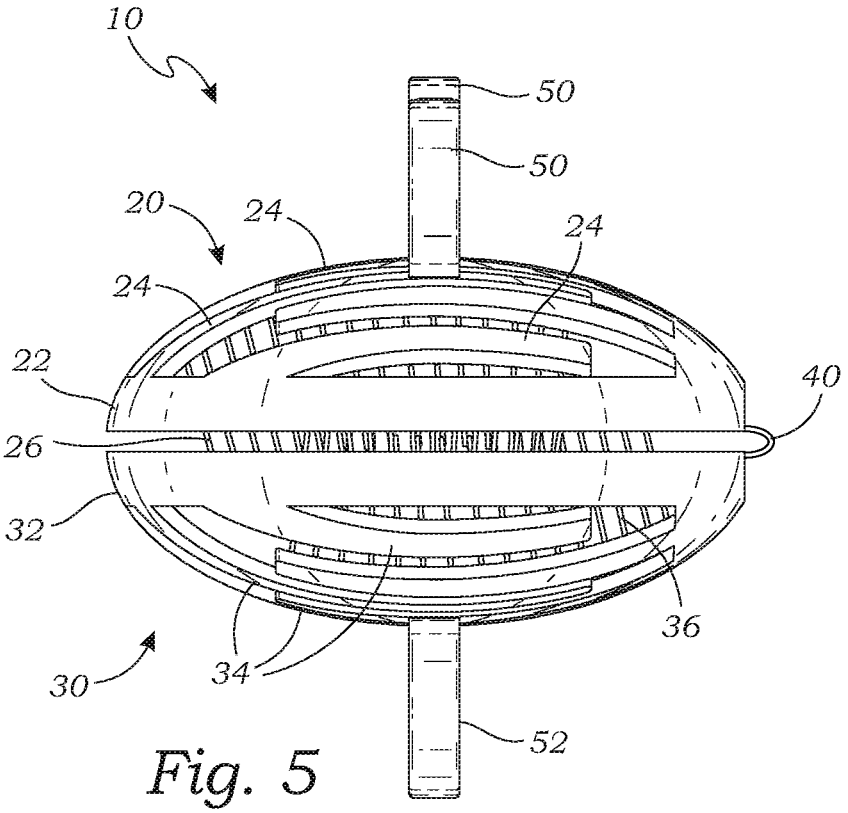
FIG. 5 is a left side elevational view thereof.
Figure 6:
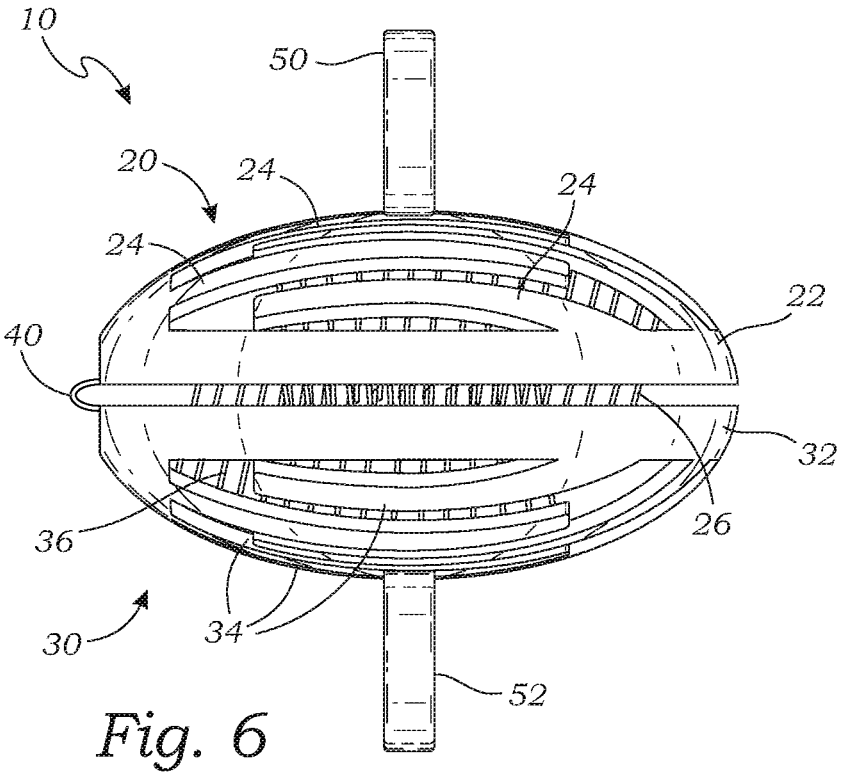
FIG. 6 is a right side elevational view thereof.

FIG. 5 is a left side elevational view of the detangling brush 10, and FIG. 6 is a right side elevational view thereof. As shown in FIGS. 3-6, the top and bottom perimeter frames 22 and 32 may be spaced a distance apart, such that hair may pass therethrough in the closed configuration.

Figure 7:
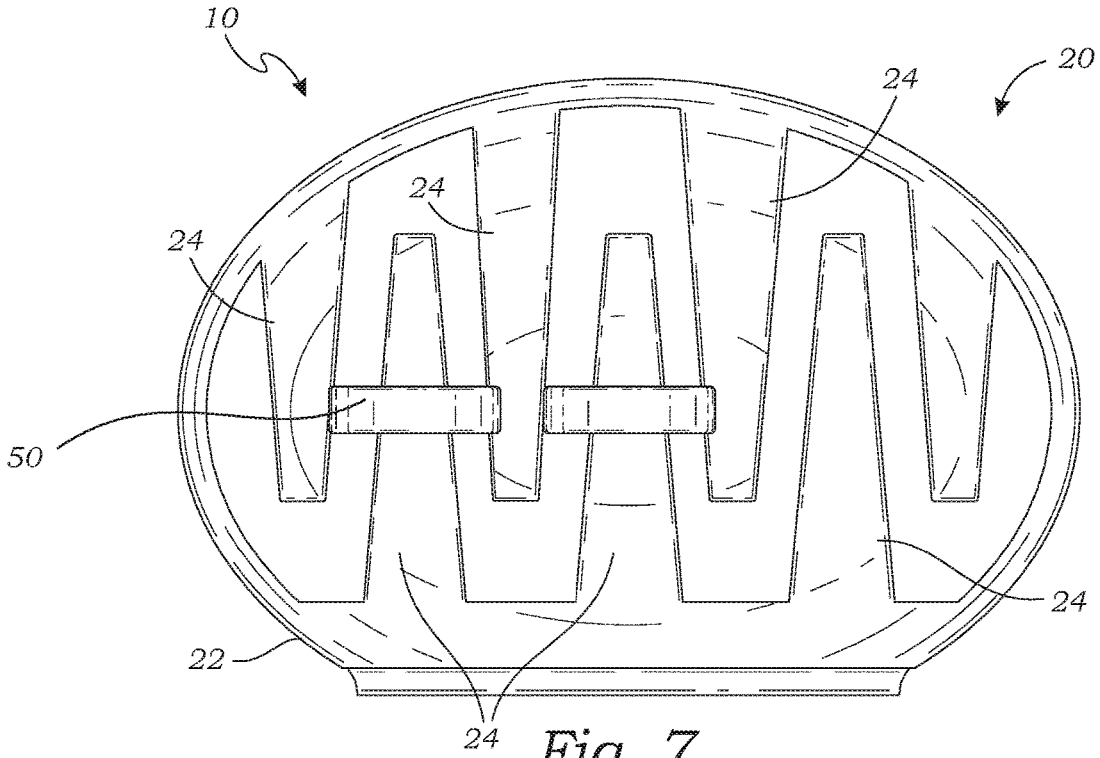
FIG. 7 is a top plan view thereof.
Figure 8:
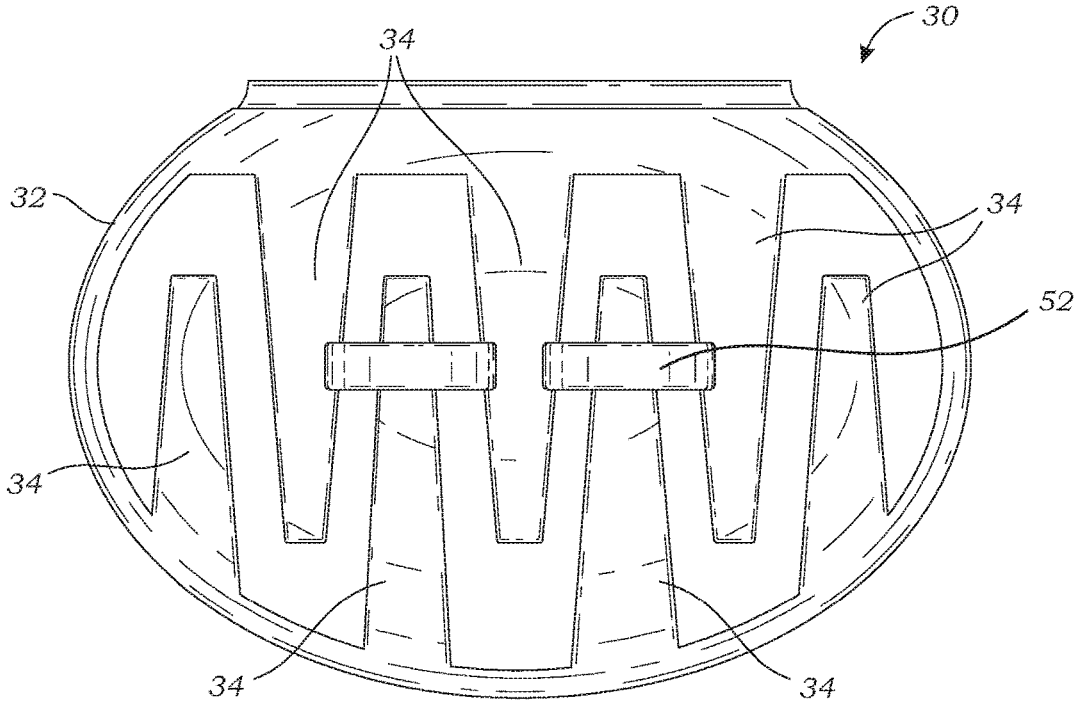
FIG. 8 is a bottom plan view thereof.

FIG. 7 is a top plan view of the detangling brush 10, and FIG. 8 is a bottom plan view thereof, showing the first and second extending fingers 24 and 34 alternating within their respective frames 22 and 32. As shown in FIGS. 2-8, the alternation of the fingers 24 and 34 allows for the detangling brush 10 to be closed without the bristles 26 and 36 sitting on top of each other, such that the detangling brush 10 may be easily stored and/or transported in the closed configuration. The alternation of the fingers 24 and 34 may also assist in cleaning the detangling brush 10 in the open configuration, as the plurality of bristles 26 and 36 are sectioned apart, allowing ease of access during hair removal.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A detangling brush comprising:

a top brush head having a top perimeter frame which includes a first plurality of inwardly extending fingers that extend from the top perimeter frame, each of the first plurality of inwardly extending fingers being laterally spaced from each other, and further comprising a plurality of top bristles which project downwardly from at least some of the first plurality of inwardly extending fingers of the top brush head;

at least one ring mounted on the top brush head, being sized and shaped to receive a user's fingers;

a bottom brush head having a bottom perimeter frame which includes a second plurality of inwardly extending fingers that extend from the bottom perimeter frame, each of the second plurality of inwardly extending fingers of the bottom brush head being laterally spaced from each other, and further comprising a plurality of bottom bristles which project upwardly from at least some of the second plurality of inwardly extending fingers of the bottom brush head; and a hinge that hingably connects the top and bottom brush heads.

2. The detangling brush of claim 1, wherein the at least one ring is mounted on an outer surface of one of the first plurality of inwardly extending fingers.

3. The detangling brush of claim 2, further comprising a pair of rings that are mounted on an outer surface of two of the second plurality of inwardly extending fingers.

4. The detangling brush of claim 1, wherein the at least one ring comprises a pair of rings are mounted on an outer surface of two of the first plurality of inwardly extending fingers.

5. The detangling brush of claim 1, wherein the hinge is a living hinge.

6. The detangling brush of claim 1, further comprising at least one ring that is mounted on an outer surface of the bottom brush head.

7. A detangling brush comprising:

a top brush head having a top perimeter frame which includes a first plurality of inwardly extending fingers that extend from the top perimeter frame, each of the first plurality of inwardly extending fingers being laterally spaced from each other, and further comprising a plurality of top bristles which project downwardly from at least some of the first plurality of inwardly extending fingers of the top brush head;

at least one ring mounted on the top brush head, being sized and shaped to receive a user's fingers;

a bottom brush head having a bottom perimeter frame which includes a second plurality of inwardly extending fingers that extend from the bottom perimeter frame, each of the second plurality of inwardly extending fingers of the bottom brush head being laterally spaced from each other, and further comprising a plurality of bottom bristles which project upwardly from at least some of the second plurality of inwardly extending fingers of the bottom brush head;

a hinge that hingably connects the top and bottom brush heads; and further comprising a pair of rings that are mounted on an outer surface of two of the second plurality of inwardly extending fingers.

* * * * *